United States Patent [19]

Yokoi

[11] 4,279,417

[45] Jul. 21, 1981

[54] OBSTACLE GAME MACHINE

[75] Inventor: Gunpei Yokoi, Kyoto, Japan

[73] Assignee: Nintendo Co., Ltd., Kyoto, Japan

[21] Appl. No.: 60,035

[22] Filed: Jul. 23, 1979

[30] Foreign Application Priority Data

Sep. 8, 1978 [JP] Japan ..... 53-111168

[51] Int. Cl.[3] ..... A63F 9/14

[52] U.S. Cl. ..... 273/1 E

[58] Field of Search ..... 273/1 R, 1 E, 1 M; 35/11 R

[56] References Cited

U.S. PATENT DOCUMENTS

| | | | |
|---|---|---|---|
| 2,943,855 | 7/1960 | Javna et al. | 273/1 E |
| 3,151,865 | 10/1964 | Faure et al. | 273/1 E |
| 3,171,215 | 3/1965 | Glass et al. | 273/1 E X |
| 3,568,332 | 3/1971 | Koci et al. | 273/1 E X |
| 3,831,172 | 8/1974 | Olliges et al. | 273/1 E X |

*Primary Examiner*—Paul E. Shapiro

*Attorney, Agent, or Firm*—Wenderoth, Lind & Ponack

[57] ABSTRACT

An obstacle game machine wherein a movable sheet having a running area and obstacle area is moved in a given direction, and a simulated objects to be driven is moved relative to said sheet through manipulation by the player so that said object passes the running area while staying away from the obstacle area. Said game machine comprising an obstruction detecting means having an electrically conductive mask which moves in operative association with said movable sheet and includes an obstacle conductive area for detecting entrance of said running object area and a running non-conductive area for detecting the running of said object along said running area, a first electrode in contact with the obstacle conductive area of said conductive mask and a second electrode which is movable across the conductive mask in operative association with the movement of said running object.

7 Claims, 9 Drawing Figures

OBSTACLE GAME MACHINE

BACKGROUND OF THE INVENTION

1. Field of the Invention

This invention relates to an obstacle game machine comprising a movable sheet having a running area and an obstacle area, and simulated object whose movement is to be controlled by the player. More particularly, this invention relates to an obstacle game machine wherein the player manipulates a control (such as lever or knob) to move the simulated object in a direction across a sheet, which has a running area and an obstacle area and is movable in a given direction, in such a manner that the object passes through the running area or bumps against an obstacle.

2. Description of the Prior Art

A conventional obstacle game machine is a driving game machine found in a game arcade. The player manipulates a control (lever or steering wheel) to control the position of a simulated autmobile on a continuously moving endless rubber belt which has a running area as a runway and an obstacle area consisting of rivers, buildings and race pads on both sides of the runway as well as cars running ahead or in the opposite direction, cars immobilized in the runway due to trouble, and rocks that obstruct the running of the car. To determine if the player is properly steering his automobile, a microswitch is provided at the front as well as on both sides of the body of the automobile. If he makes a mistake in the manipulation of the steering wheel and lets the car hit either the bank formed on the border between the running area and obstacle area of the movable sheet or any obstacle on the runway (such as a rock or other vehicles), one of the microswitches senses the occurrence of trouble by being turned on upon contact with such obstacle.

As described above, the movable sheet of the conventional driving game machine is equipped with a bank and other obstructive elements which cause the microswitch to be turned on, and therefore, it cannot be wound around rollers into a compact roll. On the other hand, there is a limitation to the total length of the sheet if it is designed to run in the form of an endless loop, and therefore, the same scene appears at given intervals of driving to thus reduce the pleasure of the game. Furthermore, since the driving game machine requires a large space for housing the endless sheet, it has been difficult to reduce the size of the machine to make it suitable for home use rather than for use in a game arcade.

SUMMARY OF THE INVENTION

It is therefore one object of this invention to provide an obstacle game machine which has a simple and small-sized mechanism for detecting the entrance of a simulated object into an obstacle area, or the occurrence of an obstruction, of a movable sheet.

It is another object of this invention to provide a simple and small-sized obstacle game machine for home use wherein the movable sheet is free from all projections and other obstructive elements conventionally used to turn microswitches on, to thereby reduce the volume of the sheet in a rolled state.

This invention provides an obstacle game machine wherein a movable sheet having a running area and an obstacle area is moved in a given direction, for example, from up to down or from right to left, and a simulated object to be driven which is movable across said movable sheet in a direction substantially vertical to the running direction of said sheet is moved relative to said sheet through manipulation by the player so that said object passes through the running area while staying away from the obstacle area, said game machine having an obstruction detecting means including an electrically conductive mask which moves in operative association with said movable sheet and includes an obstacle conductive area for detecting entrance of said running object into said obstacle area and a running non-conductive area for detecting the running of said object along said running area, a first electrode in contact with the obstacle conductive area of said conductive mask in operative association with the movement of said running object, said second electrode being in contact with the running non-conductive area of said conductive mask so long as the object is staying away from the obstacle area and being brought into contact with the obstacle conductive area if an obstruction occurs, such an obstruction being detected by the first and second electrodes being allowed to conduct through the obstacle conductive area of said conductive mask.

This invention also provides an obstacle game machine wherein a movable sheet having a running area and an obstacle area is moved in a given direction, for example, from up to down or from right to left, and a simulated object to be driven which is movable across said movable sheet in a direction substantially vertical to the running direction of said sheet is moved relative to said sheet through manipulation by the player so that said object passes through the running area while staying away from the obstacle area, said game machine having an obstruction detecting means including an electrically conductive mask which moves in operative association with said movable sheet and includes an obstacle conductive area for detecting entrance of said running object into said obstacle area and a running non-conductive area for detecting the running of said object along said running area, a first electrode in contact with the obstacle conductive area of said conductive mask and a second electrode which is movable across the conductive mask in operative association with the movement of said running object, said second electrode being in contact with the running non-conductive area of said conductive mask so long as the object is staying away from the obstacle area and being brought into contact with the obstacle conductive area if obstruction occurs, such obstruction being detected by the first and second electrodes being allowed to conduct through the obstacle conductive area of said conductive mask; and an electronic tone generator which limits a sequence of "run" electronic sounds that indicate the running of the object relative to the running area of the movable sheet when the first and second electrodes of the obstruction detecting means are not in a electrically conducting state, and emits sequence of "obstacle" electronic sounds that indicate the entrance of the running object into the obstacle area when said first and second electrodes are allowed to conduct.

This invention further provides an obstacle game machine having a movable sheet driving means including a drive roll and a driven roll which are horizontally and rotatably mounted in a casing, a movable sheet both ends of which are wound around the drive roll, a power unit including an electric motor, a one-way transmission mechanism which engages the power unit with the drive roll only when the electric motor is running in the forward direction, and reverse motion actuating means which, imparts the driven roll reverse rotating energy to move said movable sheet in the reverse direction whereby during forward rotation of the motor, the sheet advances toward said roll, and when the motor is running in the reverse direction, the movable sheet run rapidly toward the driven roll.

While the obstacle game machine of this invention is applicable to a driving game wherein the player steers his simulated automobile to run along a given course of road while staying away from obstacle and obstacle zones such as houses and rice pads on both sides of the road, so that he can safely reach the goal wherein the player maneuvers his tank or infantryman to attack the enemy's territory by dodging obstacles such as land mines and sinks in the field of the combat, as well as to other games by varying the kinds of obstacles and simulated objects to be controlled, the following description of one embodiment of this invention relates to a submarine game wherein the player maneuvers his simulated submarine to float up a V-shaped trench in the surface of the sea by staying away from obstacles such as mines and steep walls of rock beds. The submarine game is modified to a space traveling game by changing the submarine to a spaceship and the obstacles to rockets and meteorites coming from the outer space. It is to be noted that the goal (scoring area) may be positioned at an intermediate point of the movable sheet. But with a driving game, combat game and submarine game, by positioning a goal (scoring area) at the terminating end of the movable sheet, a skilled player can enjoy the game for a longer period of time and only a winner can see the scene of the goal, thus adding to the commercial value of the game machine.

DETAILED DESCRIPTION OF THE INVENTION

Figure 1:
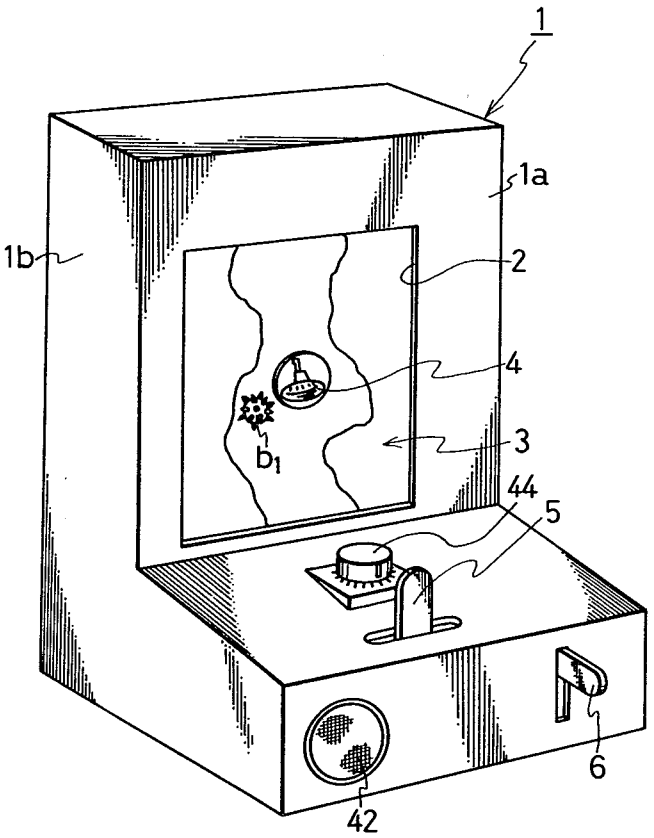
FIG. 1 is a perspective view showing the general outline the submarine game machine incorporating the principle of this invention.

This invention will now be described in detail by reference to the embodiment shown in the accompanying drawings. FIG. 1 is a general view of the submarine game machine incorporating the principle of this invention, wherein the front panel (1*a*) of the casing (1) is provided with a window (2) through which part of a movable sheet (3) and a simulated object (a simulated submarine) (4) can be seen. In FIG. 1, (5) is a control lever and (6) is a start-up lever. The machine casing (1) houses movable sheet driving means (Y), a mechanism (X) for controlling the movement of the submarine (4), obstruction detecting means (Z), and an electronic control unit (7) including an electronic tone generator, all of which will be described below.

Figure 2:
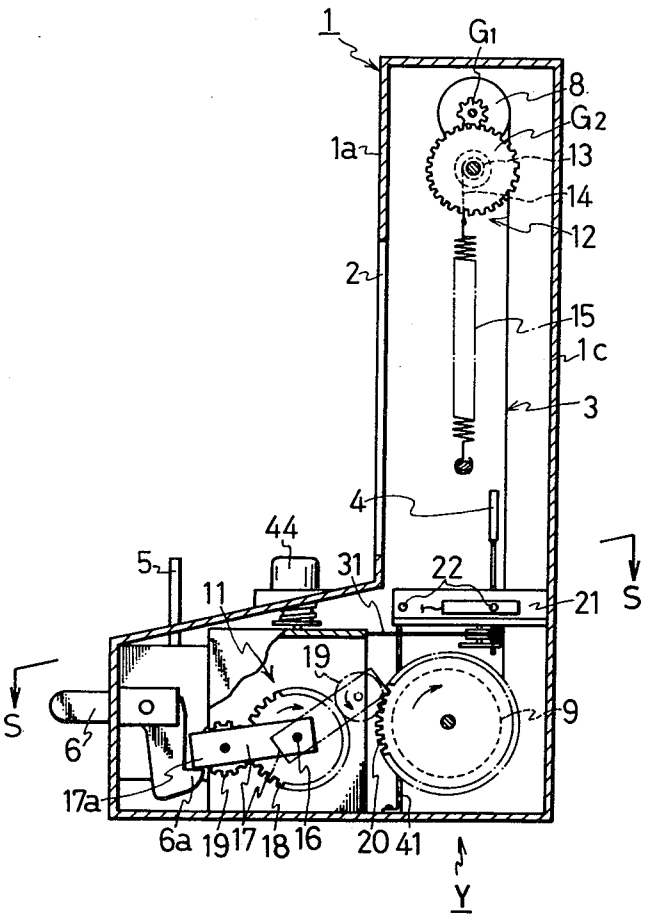
FIG. 2 is a vertical cross section of the submarine game machine shown in FIG. 1.
Figure 3:
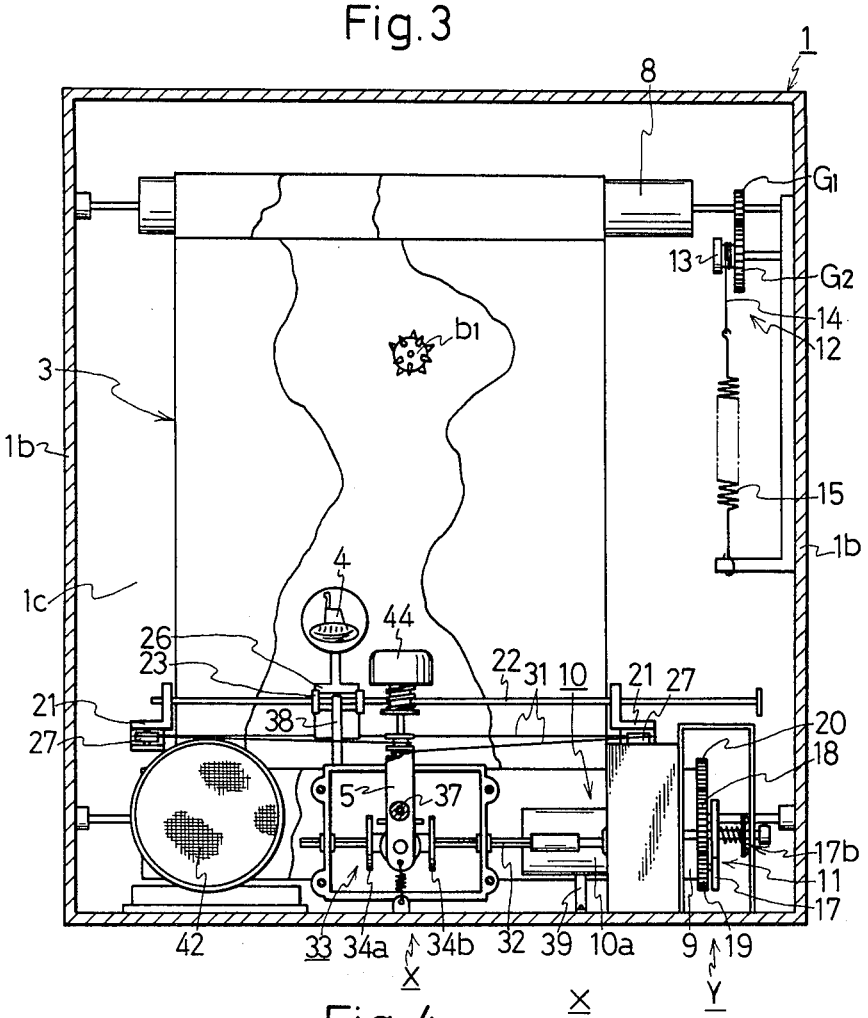
FIG. 3 is a front view of the submarine game machine of FIG. 1 with the front panel of the casing removed.

With reference to FIGS. 2 and 3, the movable sheet driving means (Y) consists of a drive roll (9) which is horizontally and rotatably mounted at the lower portion of the casing (1), a driven roll (8) which is horizontally and rotatably mounted at the upper portion of the casing (1), a movable sheet (3) both ends of which a wound around the drive roll (9) and driven roll (8), a power unit (10) including an electric motor (10*a*) and a reducing gear, a one-way transmission mechanism (11) which engages the power unit (10) with the drive roll (9) only when the electric motor (10*a*) is running in the forward direction, and reverse motion actuating means (12) which, as the movable sheet (3) is accumulated by the drive roll (9), imparts the driven roll (8) reverse rotating energy to rotate said roll, or move the sheet (3), in the reverse direction. During forward rotation of the motor (10*a*), the sheet (3) is wound around the drive roll (9) and when the motor is running in the reverse direction, the drive roll (8) idles and the reverse motion actuating means (12) causes the driven roll (8) to rotate in reverse direction, and this causes the movable sheet (3) to run rapidly toward the driven roll (upward in FIGS. 1 to 3) by being accumulated by said roll.

The reverse motion actuating means (12) consists of gears (G1)(G2), a pulley (13) integral with a gear (G2), a rope (14) wound on said pulley, and a spring (15), one end of which is secured to the rope and the other end of which secured to the side wall (1*b*) of the casing (1). The one-way transmission mechanism (11) comprises the power unit (10), having a shaft (16) to one end of which is loosely mounted the base of an arm (17), and power output gear (18), fixed to the shaft (16), is kept engaged with an intermediate gear (19) which is rotatably supported on one end of the arm; when the arm (17) is positioned as shown by the phantom line in FIG. 2, the one-way transmission mechanism (11) causes the output gear (18) to engage the drive gear (20) in the forward direction, and by the reverse running of the motor (10*a*), the arm (17) rotatably shifts to the position indicated by the solid line in FIG. 2, to thereby disengage the output gear (18) from the drive gear (20). When the arm (17) is in the position indicated by the solid line, the pawl (6*a*) of the start-up lever (6) is in engagement with the end (17*a*) of the arm. If the lever (6) is depressed, the pawl (6*a*) pushes the end (17) up, whereupon a switch (17*b*) operatively associated with the arm (17) is turned on to start the forward running of the motor (10*a*), and the rotational force of the output gear (18) causes the gear (19) to revolve around said output gear as it comes closer to the drive gear (20) until it is in the position indicated by the phantom line, thus permitting the drive roll (9) to transmit the forward motion of the motor (10*a*) to the driven roll (8).

Figure 4:
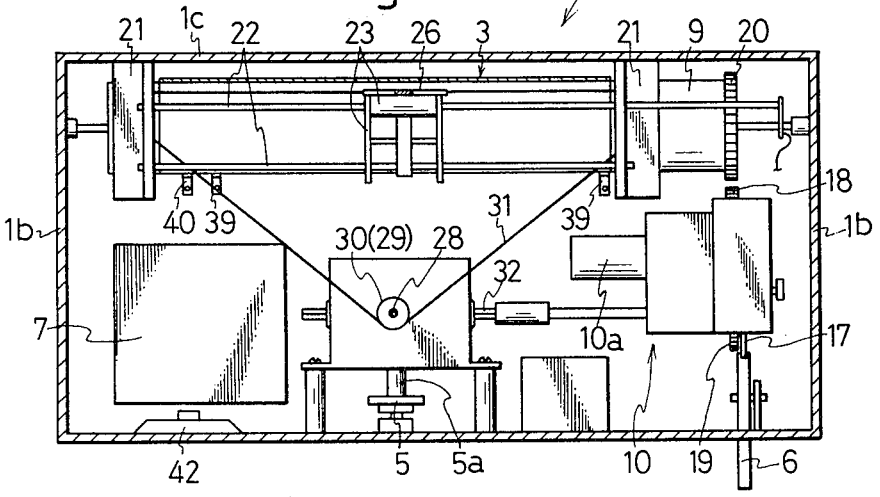
FIG. 4 is a cross-section of FIG. 2 taken on the line S—S.
Figure 8:
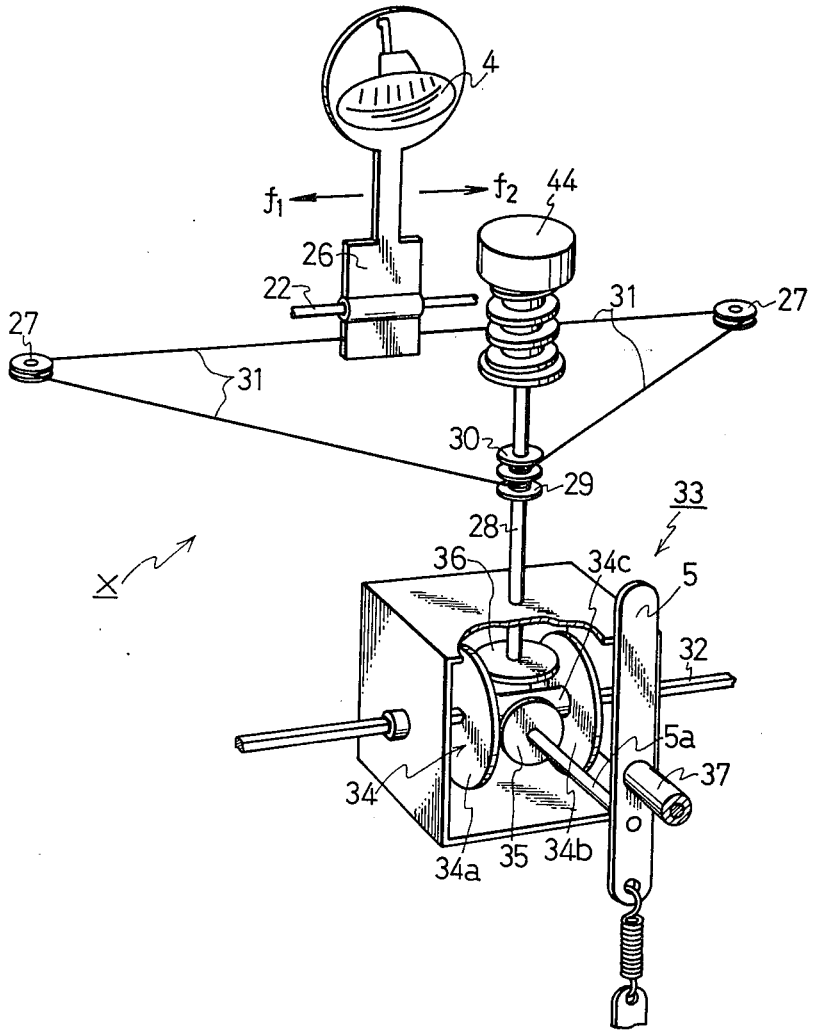
FIG. 8 is a perspective view showing the mechanism for switching between forward and reverse transmissions wherein a control lever is manipulated at adjust the position of a submarine from right to left and vice versa.

The mechanism (X) for controlling the movement of the submarine (4) is now described with reference to FIGS. 4, 6 and 8. To a supporting plate (21) fixed to the rear panel (1*c*) of the casing, both ends of each of two parallel and horizontal guide rods (22),(22) are fixed. The guide rods (22),(22) are passed through holes (24), (25) of sliding members (23) to make said members slidable along said rods. A vertical plate (26) integrally formed with or attached to the rear end of each sliding member (23) has a disc in its upward extention. The disc serves as a simulated submarine (4) which is moved from right to left and vice versa through the horizontal movement of the sliding members (23). As shown in FIG. 8, a rope (31) is wound round pulleys (27),(27) rotatable supported on the supporting plates (21),(21) and pulleys (29), (30) fixed to a drive vertical shaft (28), and part of the rope (31) is fastened to the vertical plate (26), and like a dial plate of a radio used for frequency tuning, the rotational movement of the drive vertical shaft (28) is converted to a horizontal movement of the vertical plate (26), hence the submarine (4). The drive vertical shaft (28) is engaged via a two-way transmission mechanism (33) with an intermediary shaft (32) coupled to the motor (10*a*).

With reference to FIG. 8, the transmission mechanism (33) has a drive member (34) wherein a pair of drive discs (34*a*), (34*b*) that engage the intermediary shaft (32) only in the rotational direction of the drive shaft (28) so that they are horizontally movable in the axial direction of the intermediary shaft (32) and are integrally joined by a cylindrical member (34*c*). The drive member (34) is horizontally moved by an operating disc (35) rotatably connected to the tip of an operating shaft (5*a*) that can be moved back and forth by manipulating the control lever (5), so that a driven disc (36) fixed to the lower end of the drive vertical shaft (28) is brought into contact with either drive disc (34*a*) or (34*b*) to thereby rotate the drive shaft (28) in a desired direction. In this manner, the submarine (4) is rendered movable to the left (in the direction indicated by the arrow f1) or to the right (in the direction indicated by the arrow f2) via the rope (31).

In FIG. 8, there is a shown a knob (44) for changing the horizontal travelling speed of the submarine in playing the game. Said knob (44) is rotatably turned to move upwardly and downwardly a vertical drive shaft (28) and an operating disc (36) which is fixedly mounted at the lower end of said shaft (28), and to slidably move the point of contact of said operating disc (36) with drive disc (34*a*) or (34*b*) between the circumference and the center so that the ratio of transmitting speed between an intermediate shaft (32) and the vertical drive shaft (28) is changed in order to change the horizontal travelling speed of submarine (4) accordingly. As stated avove, the grade of difficulty in operating the submarine (4) is selectively changeable.

Figure 5B:
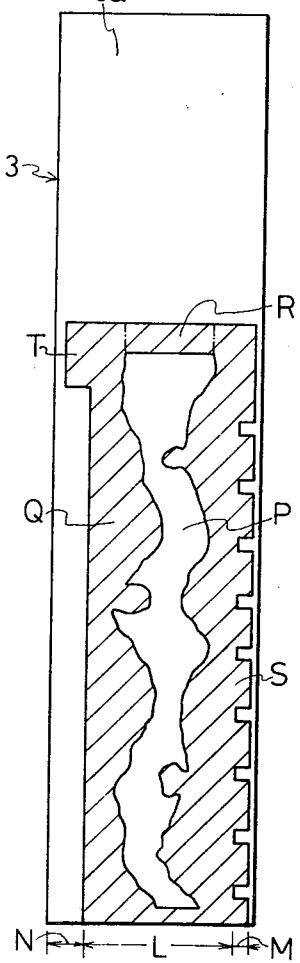
FIG. 5B shows the reverse side of the same movable sheet which constitutes an electrically conductive mask.
Figure 5A:
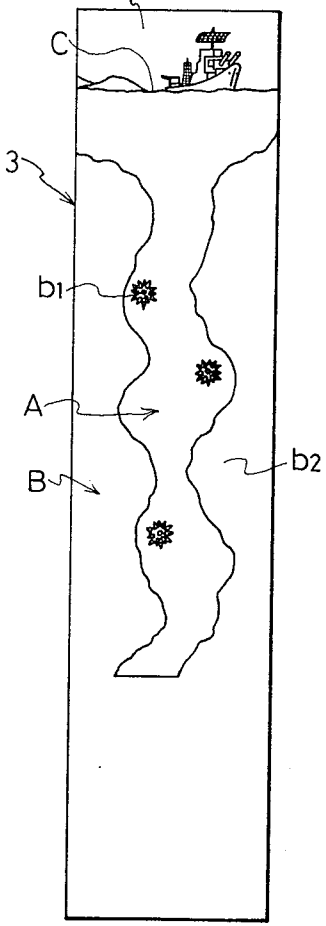
FIG. 5A shows the obverse side of the movable sheet in an unrolled form as dismounted from driven and drive rolls.

As shown in FIG. 5A, the obverse side (3*a*) of the movable sheet (3) is divided into a running area and an obstacle area. In the illustrated embodiment, a running area (A) is a trench minus the effective range of each mine (b1), and an obstacle area (B) is the steep walls of rock beds plus the effective range of each mine (b2). The movable sheet terminates with a scene at the surface of the sea (C) which is the goal of the game.

As shown in FIG. 5B, the reverse side (3*b*) of the movable sheet (3) has its shadowed portion rendered electrically conductive by the printing of ink that contains metal powder or by lamination of a metal foil to provide an electrically conductive mask for generating detection signals, and the resulting conductive mask has a game zone (L) which is divided into an obstacle conductive area (Q) and a running non-conductive area (P) which are similar to the corresponding obstacle areas (B) and running areas (A) of the obverse side (3*a*). As will be described below, a first electrode (38) is used to detect the center of the submarine (4), and so, the width of the running non-conductive area (P) that acts on the first electrode (38) is smaller than that of the running area (A) of the obverse side (3*a*) by the scale of reduction by which the width of said electrode (38) is reduced from the size of the submarine (4). The point at which the first electrode (38) acts on the reverse side (electrically conductive mask) (3*b*) differs from the position of the submarine with respect to the obverse side (3*a*) in the direction of movement of the sheet (3). To be more specific, as is clear from the comparison of FIG. 5A and 5B, the reverse side (3*b*) precedes to obverse side (3*a*) and right and left are reversed for (3*a*) and (3*b*). Continuous to the terminating end of the running non-conductive area (P) is an electrically conductive portion where a rewinding signal mark (R) is formed. One marginal edge (M) of the game zone (L) is set aside for a "run" tone zone which is provided with a sequence of "run" tone marks (S) spaced by non-conductive portions, and the other marginal edge (N) is reserved as a goal signal zone which is provided with an electrically conductive goal signal mark (T) at the terminating end of the running non-conductive area (P) and adjacent to the signal mark (R).

Figure 7:
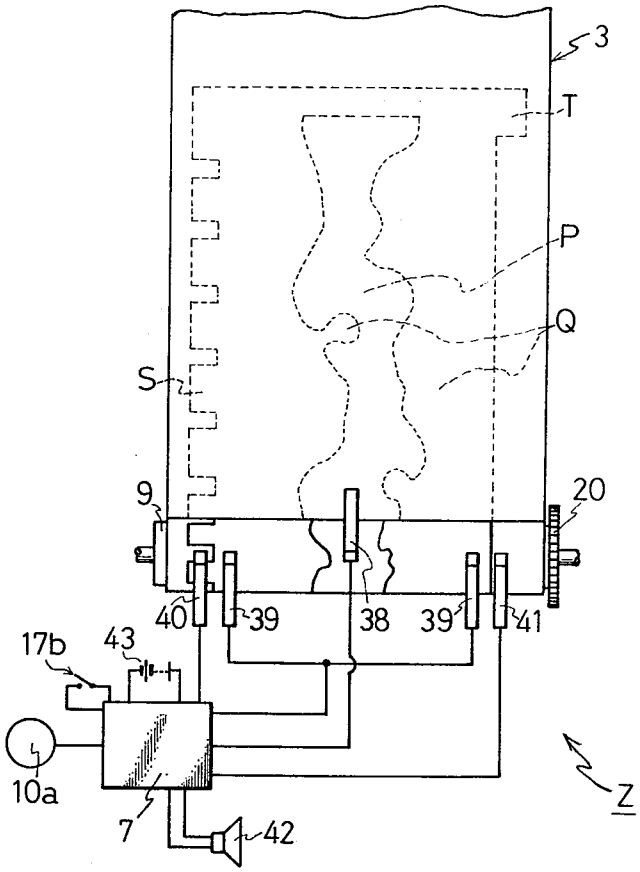
FIG. 7 is an electrical circuit diagram of the obstruction detecting means and electric tone generator used in the submarine game machine of this invention.
Figure 6:
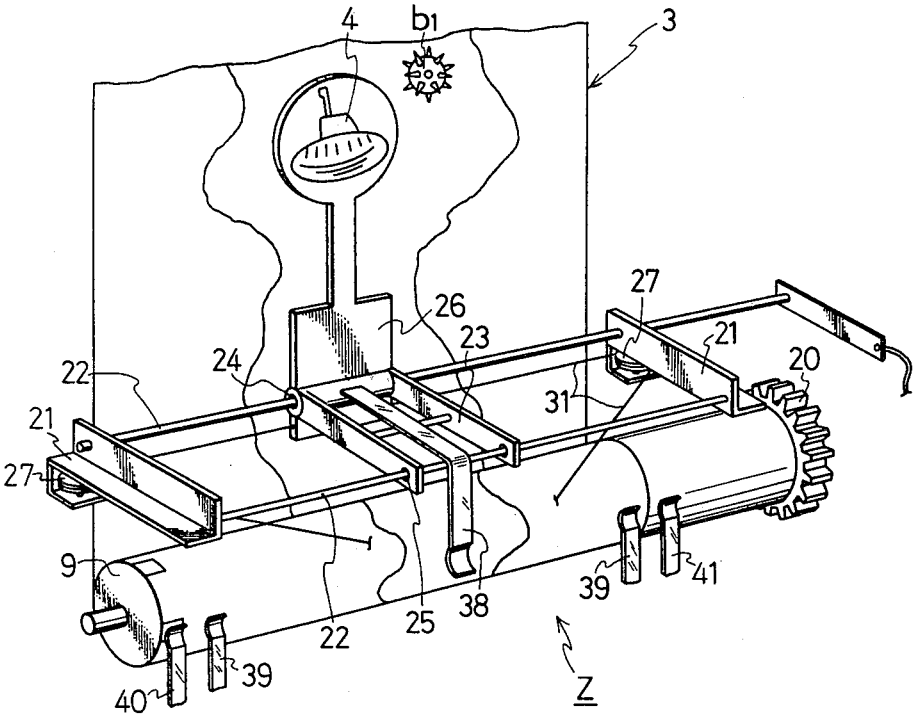
FIG. 6 is a perspective view showing the essential parts of the obstruction detecting means of the submarine game machine of this invention.

The obstruction detection means (Z) consists of the reverse side (conductive mask) (3*b*) having the above described running non-conductive area (P) and the obstruction conductive area (Q), the first electrode (38) which, as shown in FIGS. 6 and 7, is opposite the reverse side (3*b*) of the sheet (3) wound around the drive roll (9), and a pair of right and left second electrodes (39). The means (Z) also includes a third electrode (40) disposed in a position where it can contact the "run" tone mark (S) and a fourth electrode (41) disposed in a position where it can contact the goal signal mark (T).

The above described electrodes (38),(39),(40) and (41) are connected to an electronic control unit (7) which includes a motor control circuit including a switching element for switching between the forward and reverse running of the motor (10*a*) by switching between terminals of a battery (43) to the motor and for controlling the start and stop of the motor by making and breaking the connecting between the motor and the battery, and an electronic tone generator circuit for selectively emitting a "run" electronic tone, "obstruction" electronic tone and "goal" electronic tone from a speaker (42).

Said electronic tone generator circuit, the electrodes (38), (39), (40), (41), the "run" tone mark (S), signal mark (R) and goal signal mark (T) on the electrically conductive mask (3*b*) and the speaker (42) are the elements that constitute the electronic tone generating means.

The obstacle game machine of this invention described above is operated by the following procedure. Depress the start-up lever (6) to turn the start-up switch (17*b*) on, upon which the motor (10*a*) starts to run in the forward direction to rotate the drive roll (9) in the forward direction. This causes the movable sheet (3) to be accumulated by the drive roll (9), resulting in downward movement of the sheet (3). Although the vertical position of the submarine (4) remains unchanged, downward movement of the sheet (3) causes the submarine to appear to the player as if it were floating up to the surface of the sea. The player manipulates the control lever (5) to change the horizontal position of the submarine (4) so that it can safely pass through the running area as it floats up to the surface of the sea.

As long as the submarine (4) keeps safely going through the running area (A), the drive roll (9) continues to run in the forward direction to accumulate the sheet (3), whereas in the reverse motion actuating means (12) the rope (14) is woud round the pulley (13) to stretch the spring (15) until is energized for reverse movement of the sheet (3) As the sheet (3) is being accumulated by the drive roll (9), the third electrode (40) reads the "run" tone mark (S) to send intermittent signals to the electronic control unit (7) including the electronic tone generator circuit which then emits intermittent electronic sounds ("run" electronic sounds) "Pip, Pip, Pip . . . " from the speaker (42). If no "run" tone mark (S) is to be provided on the reverse side (3*b*) of the movable sheet (3), intermittent sounds can be generated either by an electronic circuit which generates intermittent signals during the rotation of the motor (10*a*) in the forward direction or by a switch disc which rotates only when the motor (10*a*) and drive roll (9) are running in the forward direction and which is brought into contact with an electrode for producing intermittent signals.

If the submarine (4), emerging up to the surface of the sea, rams a mine (b1) or the steep walls of rock beds (b2), the first electrode (38) contacts the obstacle conductive area (Q) of the electrically conductive mask (3*b*) to allow both the first and second electrodes (38) and (39) to conduct. In response to the resulting conducting state, the electronic control unit (7) emits from the speaker (42) "obstruction" electronic sounds such as "Bum! Sweesh" representing the falling of the submarine (4) instead of the "run" electronic tone, "Pip, Pip, Pip . . . ", and at the same time, it switches the terminals of the battery (43) to the motor (10*a*) to rotate the motor in the reverse direction, upon which the one-way transmission mechanism (11) disengages the drive roll (9) from the motor (10*a*), followed by the switch (17*b*) being turned off. Then, the reverse motion actuating means (12) rewinds the movable sheet (3) back to the starting point of the game, where the player again challenges by depressing the start-up lever (6).

If the submarine (4) reaches the final goal (sea level C) or enters a halfway scoring area, the fourth electrode (41) contacts the goal signal mark (T) to actuate the electronic control unit (7) to emit a "Goal" electronic tone as well as to generate signals for actuating a score display device for additional points and total points. At the same time, the first electrode (38) contacts the rewinding signal mark (R) to reverse the rotation of the motor (10*a*) until the movable sheet (3) is returned to the starting point. In the case, not only the first and second electrodes (38), (39) but also the fourth electrode (41) are allowed to contact, and accordingly, only the "goal" electronic tone, rather than the obstruction electronic tone, is emitted.

While the above illustrated embodiment uses the reverse side (3*b*) of the movable sheet (3) as an electrically conductive mask, it is to be understood that the mask may be the surface of a separate signal generating sheet which moves in conjuction with the movement of the sheet (3). This modification is advantageous in that the width and length of the separate signal generating sheet can be reduced as compared with the movable sheet (3) and so, by shortening the span of the respective electrodes, the obstruction detecting means can be made smaller.

As described in the foregoing, the obstruction detection means (Z) of this invention consists of an electrically conductive mask having a running non-conductive area and an obstacle conductive area, and first and second electrodes contacting these two areas of the conductive mask, respectively and therefore, as compared with the mechanical detection system, it provides a reliable electrical detection of obstructions (failures) in an obstacle game. In addition, it generates detection signals that facilitate the operation of an electronic tone generator and a failure times adder which clearly indicate success or failure of the game, thus adding to the pleasure of the obstacle game.

I claim:

1. An obstacle game machine including a movable sheet having a running area and an obstacle area, a simulated object to be driven by a player, wherein said obstacle game machine comprises; an obstruction detecting means having an electrically conductive mask which moves in operative association with said movable sheet and includes an obstacle conductive area and a running non-conductive area for detecting the running of said object along said running area, a first electrode in contact with said obstacle conductive mask, and a second electrode which is movable across said conductive mask in operative association with the movement of said object, said second electrode being in contact with said running non-conductive area of said conductive mask so long as said object stays away from said obstacle area, an electronic generator including a speaker and an electronic tone generator circuit in an electronic control unit for emitting a sequence of "run" electronic sounds when said first and second electrodes of said obstruction detecting means are in an electrically non-connected state, and for emitting a sequence of "obstacle" electronic sounds when said first and second electrodes of said obstruction detecting means are in an electrically connected state.

2. An obstacle game machine as set forth in claim 1, wherein said "run" electronic sounds emitting from said electronic tone generator is an intermittent sound.

3. An obstacle game machine as set forth in claim 2, wherein said electronic tone generator includes:

a "run" tone zone which is proceeded with a sequence of an electrically conductive portion of "run" tone marks spaced by non-conductive portions, said "run" tone zone marks of said "run" tone zone being fromed on said conductive mark and being electrically connected to said obstruction conductive area on said conductive mask, a third electrode which is disposed in a position where it can contact said "run" tone marks on said conductive mask, said third electrode being intermittently connected to said first electrode throught said "run" tone mark and said obstruction area on said conductive mask by the running of said conductive mask.

4. An obstacle game machine as set forth in claim 1, wherein said obstruction detecting means comprises:

an electrically conductive goal signal mark on said electrically conductive mask which is electrically connected to said obstacle conductive area and a fourth electrode which is disposed in a position where it can contact the goal signal mark, said electronic tone generator comprising:

an electronic generator circuit for emitting a "goal" electronic tone from a speaker, said circuit being operated when said fourth electrode electrically contacts said first electrode.

5. An obstacle game machine including a movable sheet having a running area and an obstacle area and a simulated object to be driven by a player, wherein said obstacle game machine comprises;

an obstruction detecting means comprising:

an electrically conductive mask, having an end portion, and which moves in association wih said movable sheet and which includes an obstacle conductive area and a running non-conductive area for detecting the running of said object along said running area, a first electrode in contact with the obstacle conductive mask and a second electrode which is movable across said conductive mask in operative association with the movement of said object, said second electrode being in contact with the running non-conductive area of said conductive area of said conductive mask so long as said object stays away from the obstacle area, a movable sheet driving means comprising:

a drive roll and a driven roll which are horizontally and rotatably mounted in a casing and around which both ends of said movable sheet are wound, a power unit including an electric motor, a one-way transmission mechanism engaging in said power unit which said drive roll only when said electric motor is running in the forward direction, and a reverse motion actuating means which, as said movable sheet is accumulated by said drive roll, imparts to said driven roll reverse rotating energy to rotate said movable sheet in the reverse direction, wherein during said forward rotation of said motor, said movable sheet is wound around said drive roll and advanced toward said drive roll and wherein during said reverse rotation of said motor, said reverse motion actuating means operates such that said movable sheet is rapidly moved toward said driven roll.

6. An obstacle game machine as set forth in claim 5, wherein said movable sheet driving means is arranged such that:

said drive roll is horizontally and rotatably mounted at the lower portion of said casing and said driven roll is horizontally and rotatably mounted at the upper portion of said casing, wherein during said forward rotation of said motor, said movable sheet is advanced toward said drive roll at the lower portion of said casing such that a downward movement of said movable sheet is effected.

7. An obstacle game machine as set forth in claim 5, wherein a rewinding signal mark is formed in the end portion of said conductive mask, said rewinding signal mark being an electrically conductive portion which is electrically connected to said obstacle conductive area and is in the continued portion of the end portion of said running non-conductive area, wherein at the end portion of said conductive mask, said first electrode is connected to said second electrode through said signal mark and said obstacle conductive area on said conductive mask.

* * * * *